US007600330B2

(12) United States Patent
Chen

(10) Patent No.: US 7,600,330 B2
(45) Date of Patent: Oct. 13, 2009

(54) SHOE STRUCTURE

(75) Inventor: Ming-Jeng Chen, Taipei Hsien (TW)

(73) Assignee: EU-Top Corporation (TW)

( * ) Notice: Subject to any disclaimer, the term of this patent is extended or adjusted under 35 U.S.C. 154(b) by 635 days.

(21) Appl. No.: 11/371,793

(22) Filed: Mar. 9, 2006

(65) Prior Publication Data

US 2007/0209232 A1 Sep. 13, 2007

(51) Int. Cl.
*A43B 13/28* (2006.01)

(52) U.S. Cl. ..... 36/27; 36/3 B; 36/28

(58) Field of Classification Search ..... 36/27, 36/28, 3 R, 3 B
See application file for complete search history.

(56) References Cited

U.S. PATENT DOCUMENTS

| | | | | | |
|---|---|---|---|---|---|
| 507,490 | A * | 10/1893 | Gambino | 36/3 B |
| 819,449 | A * | 5/1906 | Otterstedt | 36/3 B |
| 904,891 | A * | 11/1908 | Otterstedt | 36/3 B |
| 1,144,188 | A * | 6/1915 | Gerlach | 36/3 R |
| 1,380,879 | A * | 6/1921 | Young | 36/3 R |
| 2,668,374 | A * | 2/1954 | Seigle | 36/28 |
| 6,006,449 | A * | 12/1999 | Orlowski et al. | 36/27 |
| 6,055,747 | A * | 5/2000 | Lombardino | 36/37 |
| 6,751,891 | B2 * | 6/2004 | Lombardino | 36/28 |
| 2002/0133976 | A1 * | 9/2002 | Crutcher | 36/27 |
| 2002/0189134 | A1 * | 12/2002 | Dixon | 36/27 |
| 2004/0154191 | A1 * | 8/2004 | Park | 36/28 |
| 2005/0204584 | A1 * | 9/2005 | Ryoo | 36/27 |
| 2005/0241184 | A1 * | 11/2005 | LeVert et al. | 36/27 |

* cited by examiner

*Primary Examiner*—Marie Patterson
(74) *Attorney, Agent, or Firm*—Schmeiser, Olsen & Watts

(57) ABSTRACT

The present invention provides an improved shoe structure to improve the sport efficiency and the wearing comfort of the user. The shoe structure comprises a base portion and a cover portion, wherein a plurality of flexible devices, such as springs, are formed within the base portion of the shoe structure to provide a load-bearing function. The shoe structure of the present invention is designed not only to provide comfort but also to bear a high load of weight such that the foot of the user can be protected by minimizing the impact force produced from the ground when the user steps or jumps on the ground. A plurality of air gaps are formed within the shoe structure to circulate the air within the shoe structure so that the foot of the user can keep dry and active in a clear environment.

9 Claims, 5 Drawing Sheets

SHOE STRUCTURE

BACKGROUND OF THE INVENTION

1. Field of Invention

The present invention relates generally to a structure of a shoe. More particularly, the present invention relates to a shoe structure that comprises a flexible device to improve the sport efficiency and the comfort ability of the shoes.

2. Description of the Related Art

Shoes have become the necessary accessory of our daily life. For most of people, shoes are worn for the purposes of preventing the feet from getting filthy from the ground, or getting injury by some sharp objects on the ground. For sport candidates, the shoe structure and its design can be a complemented tool to the user to improve the sport efficiency, such as runner candidates, high-jump candidates or basketball players, the shoes that they wear can help them to increase their speed, the height or the distance they jump.

The conventional shoe structure is designed with a soft shoe pad located between the sole of the foot and the base part of the shoe in order to provide comfort to the user. Air bags are also utilized in the conventional shoes structure to absorb the impact force produced from the ground in order to minimize the injury to the feet of users. Those conventional shoes are made of EVA (Ethylene Vinyl Accetate Copolymer), PU (hard Polyurethane Elastomer), TPR (Thermoplastic Rubber) or TPU (Thermoplastic Polyurethance) materials. Those materials utilized in the shoe fabrication can replace the functions of the air bags. Those prior art are usually designed with lines pattern on the base part of the shoe structure in order to increase its roughness so that the fiction between the ground and the shoes can be increased. A good design pair of sport shoes can improve the sport candidates performance such his running speed.

However, those EVA, PU, TPR or TPU materials used in the shoes can increase the comfort ability of the shoe to be wore but its absorb ability of the impact force is limited. Further, although the line pattern design can increase the roughness of the shoes in order to increase the fiction between the shoes and the ground, the functions of the shoes in respect to the sport activities are restricted. Therefore, for certain sport users, a pair of shoes with good functions is needed.

SUMMARY OF INVENTION

The present invention provides an improved shoe structure, wherein the shoe structure comprises a base portion and a cover portion. The base portion comprises at least one space, wherein a load-bearing surface is located inside the base portion and is in contacted with a sole of foot of a user when the shoes structure is being worn. The cover portion is adhered to the base portion, wherein the cover portion and the base portion cover the load-bearing surface partially, and the cover portion of the shoe structure covers the foot of the user when it is being worn. At least one flexible device, such as a spring is located within the space of the base portion. The load-bearing limit of the shoe structure of the present invention is within a weight range of the user so that the foot of the user can be protected in order to minimize the impact force from the ground to the foot of the user when the user steps or jumps on the ground.

Both the foregoing general description and the following detailed description are exemplary and explanatory only and are restrictive of the invention, as claimed.

BRIEF DESCRIPTION OF THE DRAWINGS

The accompanying drawings are included to provide a further understanding of the present invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
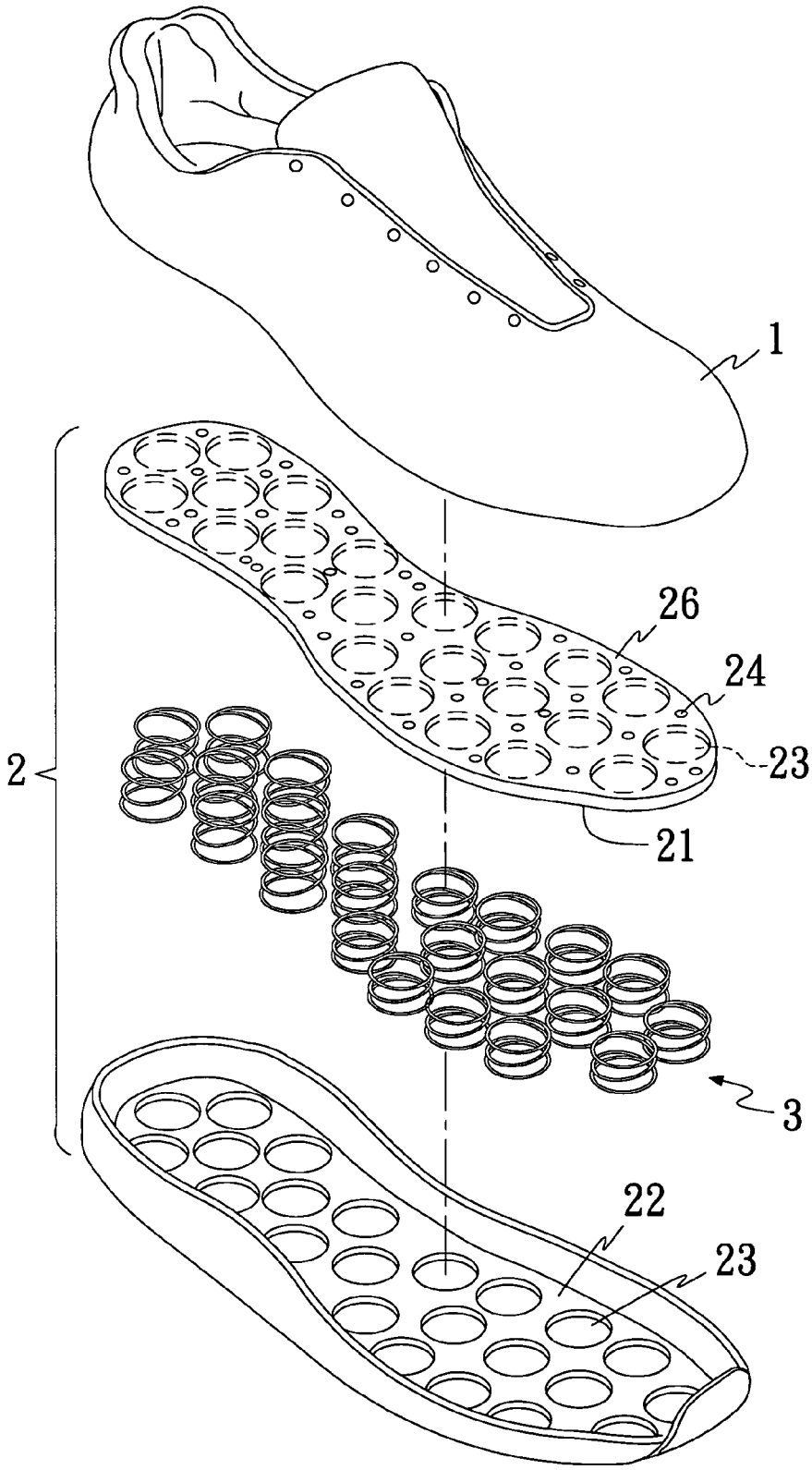
FIG. 1 is a 3-D assembly view of a shoe structure in accordance with a preferred example of the present invention.
Figure 2:
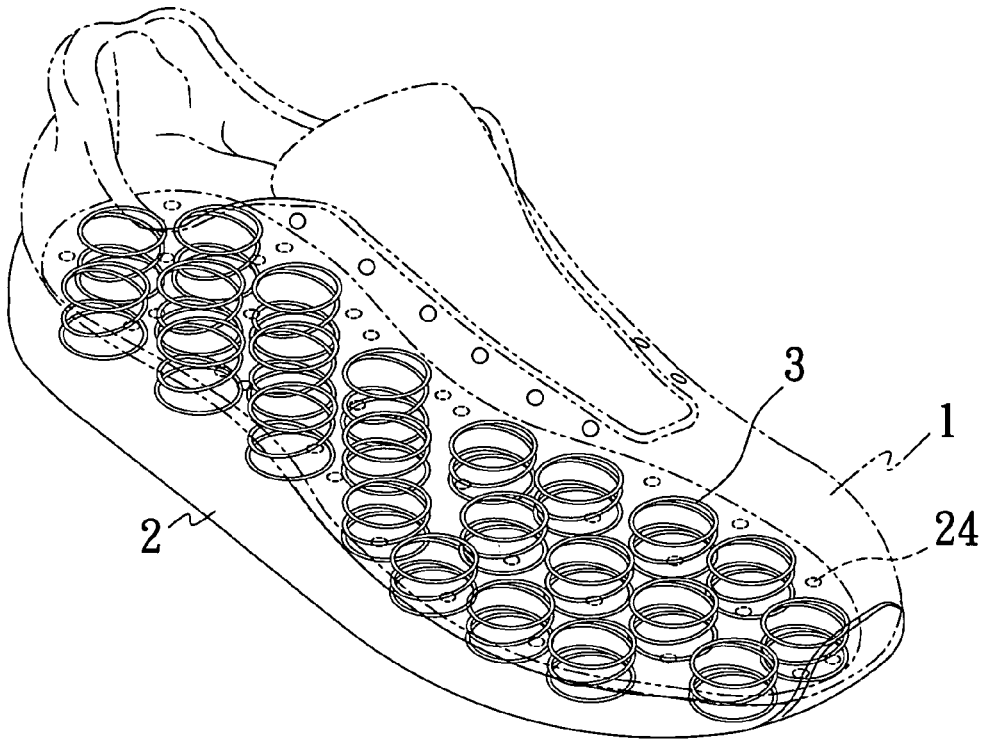
FIG. 2 is a schematic 3-D view of an assembled shoe structure in accordance with the preferred example of the present invention.
Figure 3:
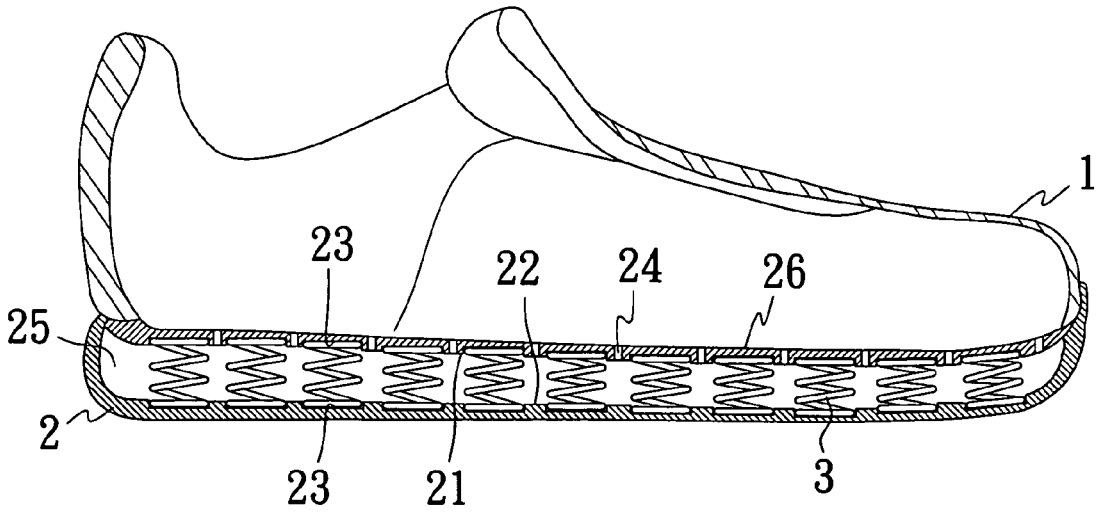
FIG. 3 is a schematic side view of an assembled shoe structure in accordance with the preferred example of the present invention.
Figure 4:
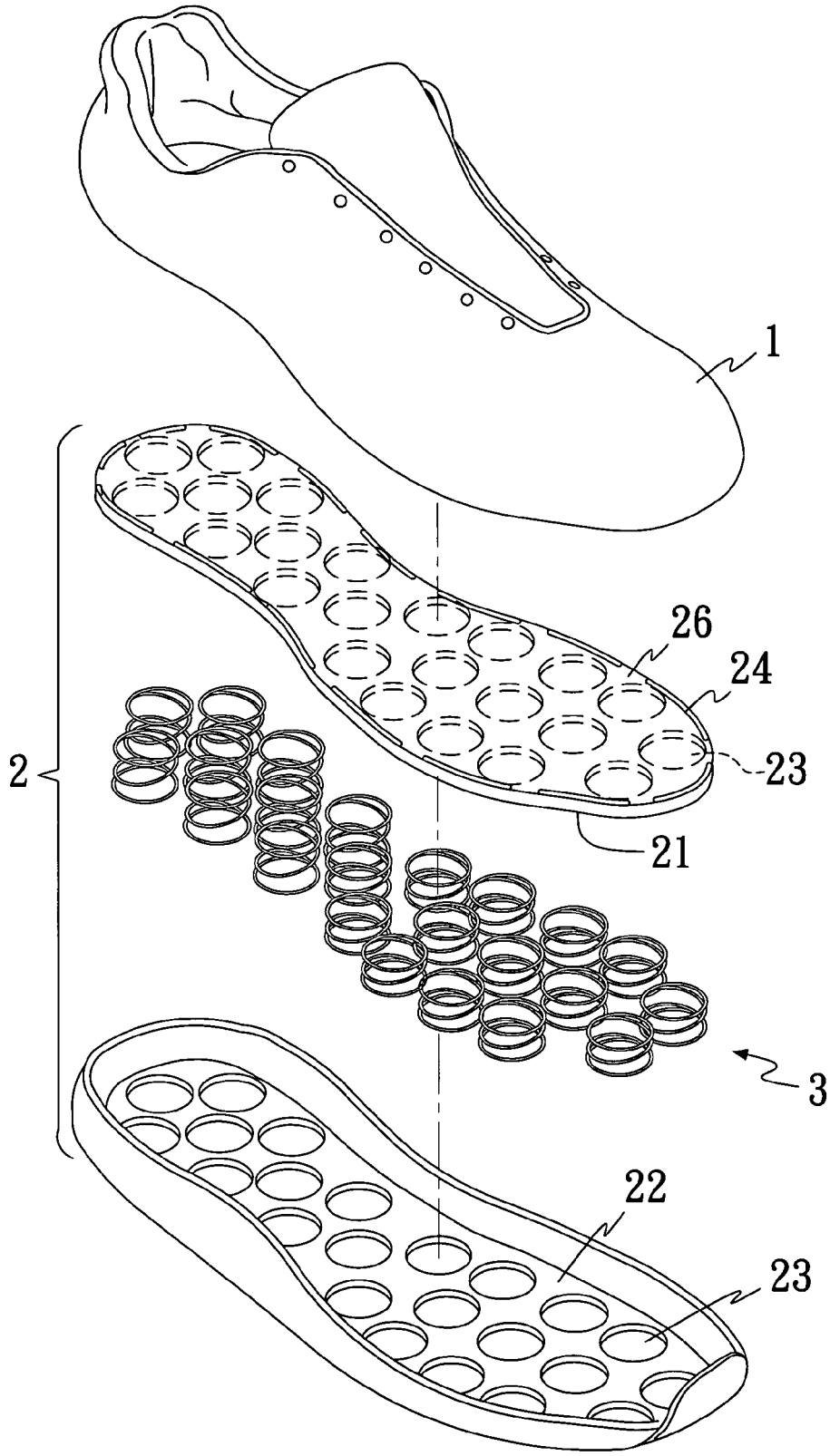
FIG. 4 is a 3-D assembly view of a shoe structure in accordance with another preferred example of the present invention.

FIGS. 1-4 show 3-D assembly views of an improved shoe structure according to a preferred example of the present invention. The improved shoe structure of the present invention provides a cover portion 1, a base portion 2 and a plurality of flexible devices 3, such as springs 3. The base portion 2 comprises a space 25 inside the base portion 2. A load-bearing surface 26 of the base portion 2 is in contact with the sole of the foot of a user when the shoe structure of the present invention is wore on. A shoe pad can be installed in between the load-bearing surface 26 of the base portion 2 and the sole of the foot. The cover portion 1 and the base portion 2 are connected together and partially cover the load-bearing surface 26. The cover portion 1 of the shoe structure covers the foot of the user appropriately such that the shoe structure fits the foot of the user comfortably. The space 25 of the base portion 2 further comprises a top part 21 and a bottom part 22 located on top and bottom sides of the space 25 respectively. The top part 21 is located on a back side of the load-bearing surface 26.

A plurality of slots 23 are formed on the top part 21 and the bottom part 22 respectively. Every slot 23 of the top part 21 is located correspondingly to every position of the slots 23 of the bottom part 22. The springs 3 are made of metal materials, such as carbon-steel (wherein non-metal material can be utilized to form the springs, for example carbon fiber.). The springs 3 are located within the space 25 of the base portion 2, wherein two ends of the springs 3 are locked within the slots 23 located on the top part 21 and the bottom part 22 in order to prevent the springs 3 from deviating away their positions.

Those springs 3 are flexible devices that can be deformed its shape when they are compressed in order to absorb impact force. The springs 3 located inside the shoe structure are to provide support for the foot, and to reduce the reaction force impacted on the foot when the user steps on the ground so that the injury to the foot can be minimized to minimum. The foot of the user can be protected from the impact. The springs 3 can relieve the pressure and retrieve back to their shapes. Further, the springs 3 can produce rebounding force to assist the user increasing the running speed and the jumping height in order to improve the sport efficiency and the utility. The rebounding force also can providing massage to the foot of the user such that the comfort ability of the shoe structure is increased.

The springs 3 are designed according to a wire diameter, a pitch, a spring diameter and a spring free length, wherein any changes of those values, the properties of the springs will be affected. The springs of the present invention are designed with a wire diameter between 1.0 millimeter (mm) to 3.5 mm, a wire pitch between 1.0 mm to 30 mm, a spring diameter between 10.0 mm to 50.0 mm and a spring free length between 10.0 mm to 50 mm. The wire diameter of the springs 3 of the present invention is preferably 2.5 mm, the wire pitch is preferably 20.0 mm, the spring diameter of the springs 3 is preferably 30.0 mm and the spring free length is preferably 30.0 mm. Tests are performed on runners wearing the improved shoe structures of the present invention and the conventional shoe structures, and are recorded in respect with the running speeds and the jumping heights of the runners.

Table 1 contains six runners' records, A, B, C, D, E and F with their heights and body weights, 184 cm, 63 kg; 185 cm, 69 kg; 174 cm, 68 kg; 181 cm, 68 kg; 166 cm, 63 kg and 173 cm, 65 kg respectively. Table 1 shows 100 m records respectively of the six runners wearing the shoe structures of the present invention and wearing the conventional shoe structures. The records illustrate that when the runners, A-F, wear the shoe structures of the present invention, their running speeds would improve drastically, with improvements of 0.55 seconds, 0.71 seconds, 0.78 seconds, 0.74 seconds, 0.65 seconds, and 0.62 seconds respectively. The average body weight of the six runners is about 66 kg, the improvement of those runners is approximately 0.675 seconds.

Table 2 shows three jumpers, B, C and D, with height and body weights, 185 cm, 69 kg; 174 cm, 68 kg and 181 cm, 68 kg respectively. Table 2 contains several high-jump records respectively of the three runners wearing the shoe structures of the present invention and wearing the conventional shoe structures. When the jumpers, B-D, wear the shoe structures of the present invention, the jumping heights would improve 6.5 cm, 5.0 cm and 4.25 cm respectively. The average body weight of the three jumpers is about 68.33 kg, the improvement of those jumpers is approximately 5.25 cm. Therefore, the present invention provides an improved shoe structure with springs that can improve the sport efficiency of the user. The current 100 m World Record is maintained by a Jamaican, Powell with a record 9.77 seconds. If a contestant would wear the improved shoe structure of the present invention, the 100 m World Record could be overwritten as the time can be reduced within 9 seconds.

TABLE 1

| | | 100 m (seconds) | | | | | |
|---|---|---|---|---|---|---|---|
| | | Runner | | | | | |
| | | A | B | C | D | E | F |
| Conventional shoes | First | 14'08 | 14'17 | 14'46 | 14'28 | 14'35 | 14'40 |
| | Second | 14'18 | 14'03 | 14'32 | 14'35 | 14'42 | 14'56 |
| Average | | 14'13 | 14'10 | 14'39 | 14'32 | 14'39 | 14'48 |
| The improved shoe structures of the present invention | First | 13'60 | 13'40 | 13'71 | 13'60 | 13'72 | 13'78 |
| | Second | 13'55 | 13'38 | 13'50 | 13'56 | 13'76 | 13'93 |
| Average | | 13'58 | 13'39 | 13'61 | 13'58 | 13'74 | 13'86 |

TABLE 1-continued

| | 100 m (seconds) | | | | | |
|---|---|---|---|---|---|---|
| | Runner | | | | | |
| | A | B | C | D | E | F |
| Amount of time reduced | 0.55 | 0.71 | 0.78 | 0.74 | 0.65 | 0.62 |

TABLE 2

| | | high jump (cm) | | |
|---|---|---|---|---|
| | | Jumper | | |
| | | B | C | D |
| Conventional shoes | First | 296 | 282 | 283 |
| | Second | 299 | 276 | 282 |
| | Third | 300 | 279 | 280 |
| | Fourth | 297 | 280 | 279 |
| Average | | 298 | 279.25 | 281 |
| The improved shoe structure of the present invention | First | 304 | 285 | 286 |
| | Second | 306 | 284 | 285 |
| | Third | 303 | 283 | 286 |
| | Fourth | 304 | 285 | 284 |
| Average | | 304.5 | 284.25 | 285.25 |
| Increase in heights | | 6.5 | 5.0 | 4.25 |

The springs 3 of the present invention, its load-bearing is 25 kg/per every spring, for an example, a shoe with 12 units of the springs 3, the shoe can bear a load up to 300 kg. In other words, a pair of shoes with 24 units of the springs 3 can bear a total load of 600 kg. Thus, the load-bearing limit is within a weight range of the user so that the foot of the user can be protected in order to minimize the impact force from the ground to the foot of the user when the user steps or jumps on the ground.

Figure 5:
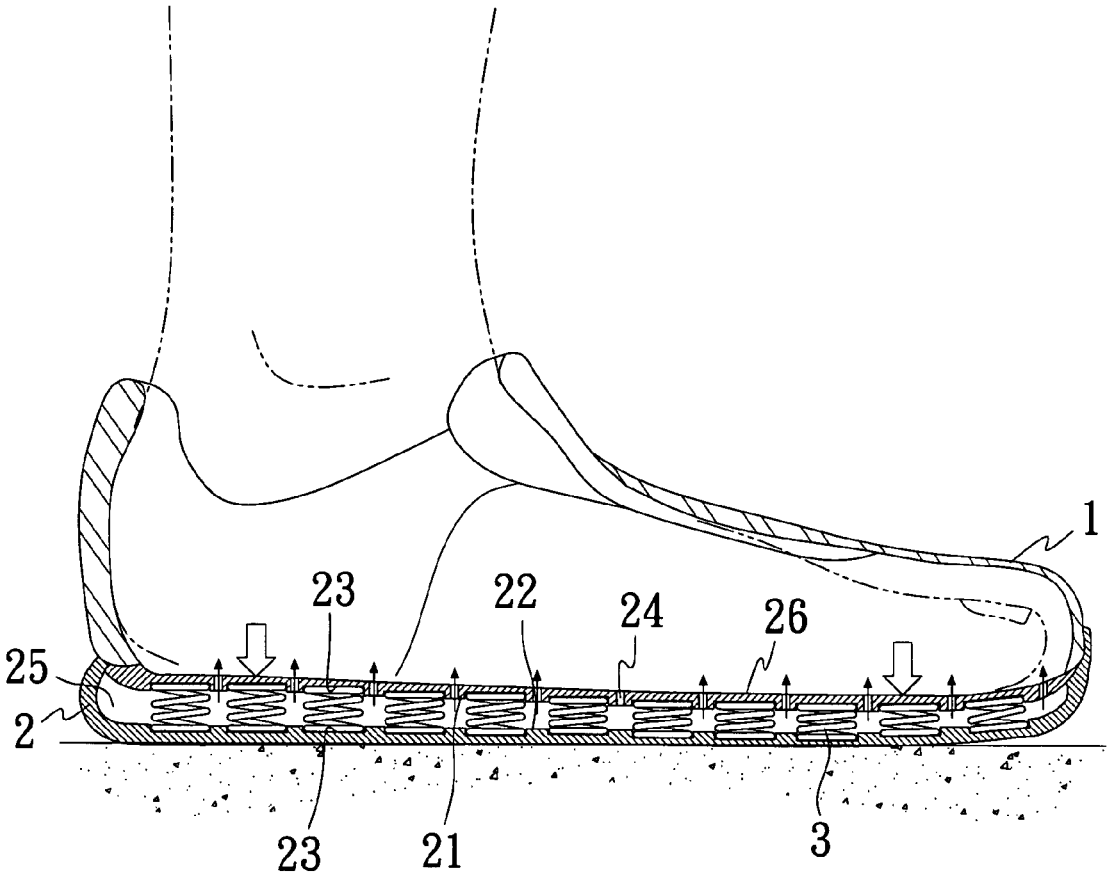
FIG. 5 is schematic side view of the shoe structure pressing on the ground.
Figure 6:
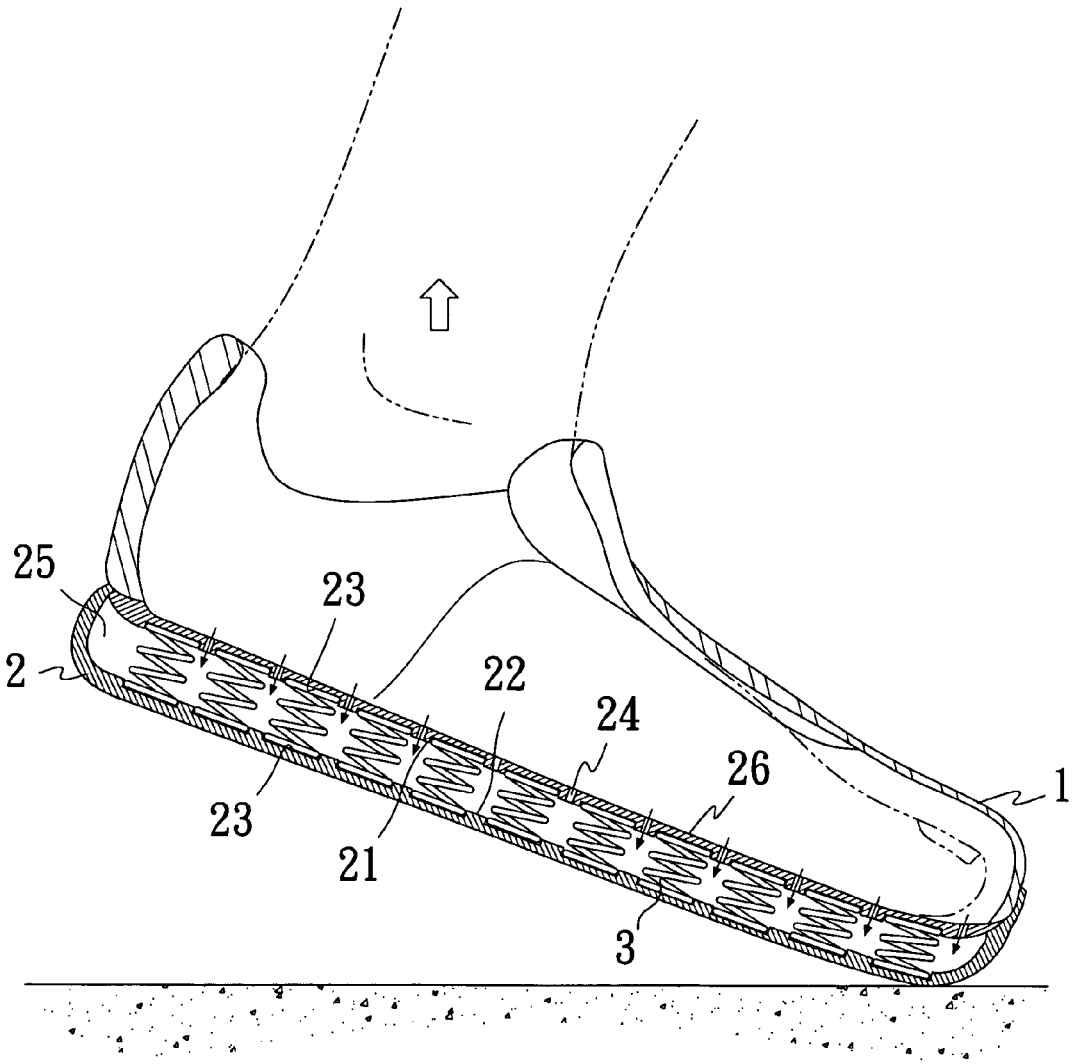
FIG. 6 is a schematic side view of the shoe structure lifting up from the ground.

The springs 3 of the base portion 2 can protect the foot. A plurality of circular air gaps 24 (could be long-shaped) are formed on the top part 21 of the base portion 2 of the shoe structure in order to circular the air inside the shoe structure so that the foot would not smell badly as a result of sweat. Thus, the feet of the user can be active in a clear environment. FIGS. 5 and 6 show schematic side views of the shoe structure pressing on the ground and lifting up from the ground. When the user steps onto the ground, the shoe structure is compressed by the weights of the user resulting the springs 3 being compressed. The space 25 of the base portion 2 would reduced, some air inside the space 25 would be pressured out from the circular air gaps 24 such that the air is circulated inside the shoe structure. The bad air can be released out from the shoe structure. When the use lift up the foot away from the ground, the springs 3 would decompress back to their shapes resulting the space 25 to expand, and external fresh air would flow into the space 25 of the shoe structure via the circular air gaps 24 such that air can be circulated inside the shoe structure. Therefore, the feet of the user can be active in a clear and circulated environment.

The diameter of the circular air gaps 24 of the present invention is between 1.0 mm to 5.0 mm, and a distance between the circular air gaps 24 is between 5.0 mm to 50.0 mm. The preferable diameter of the circular air gaps 24 is 3.0 mm, and the preferable distance between the circular air gaps 24 is 20.0 mm. One of the preferred examples of the present invention, the springs 3 of the shoe structure are designed with preferable wire diameter 2.5 mm, preferable wire pitch 20.0 mm, preferable spring diameter 30.0 mm and preferable spring free length 30.0 mm; the circular air gaps 24 with preferable diameter 3.0 mm and preferable distance 20.0 mm; the space 25 of the base portion 2 is designed with a cross-sectional area 200 $cm^2$ and volume of 600 $cm^3$ against a weight of 70 kg. When an air-flow test is performed on a user with shoe size 10.5, the springs 3 is compressed or expanded 1 cm, the air flow volume is 200 $cm^2 \times 1$ cm=200 $cm^3$ The forgoing is considered illustrative of the principles of the invention. As variations and related embodiments may occur to those skilled in the art, it is to be appreciated the invention, and all suitable modifications and equivalents, are only to be limited by the scope of the claims following hereinafter.

What is claimed is:

1. A shoe structure comprising:

a base portion, having at least one space, wherein a load-bearing surface is located inside the base portion and is in contacted with a sole of foot of a user when the shoe structure is being worn;

a cover portion, connecting to the base portion, wherein the cover portion and the base portion cover the load-bearing surface partially, and the cover portion of the shoe structure covers the foot of the user when it is being worn; and a plurality of spring devices, locating within the space of the base portion, wherein the spring device has a wire diameter between 1.0 mm to 3.5 mm, a wire pitch between 1.0 mm to 30 mm, a spring diameter between 10.0 mm to 50.0 mm and a spring free length between 10.0 mm to 50 mm;

wherein the space of the base portion comprises a top part and a bottom part located on top and bottom sides of the space respectively, the top part is located on a back side of the load-bearing surface, a plurality of slots are formed on the top part and the bottom part, and both ends of each of the plurality of spring devices are locked into one of the slots of the top part and the bottom part of the base portion.

2. The shoe structure of claim 1, wherein the flexible device is a spring.

3. The shoe structure of claim 2, wherein the spring is made of carbon-steel materials or carbon fiber.

4. The shoe structure of claim 2, wherein the spring has a wire diameter of 2.5 mm, a wire pitch of 20.0 mm, a spring diameter of 30.0 mm and a spring free length of 30.0 mm.

5. The shoe structure of claim 1, wherein at least one air gap is formed on the top part of the base portion to circulate air inside the shoe structure.

6. The shoe structure of claim 5, wherein the air gap of the top part is formed into a long shape or a circular shape.

7. The shoe structure of claim 6, wherein the air gap of the top part comprises a diameter between 1.0 mm to 5.0 mm, and a distance between the air gaps is between 5.0 mm to 50.0 mm.

8. The shoe structure of claim 6, wherein the air gap of the top part has a diameter of 3.0 mm and a distance between the air gaps of 20.0 mm.

9. The shoe structure according to claim 1, wherein a shoe pad is utilized in between the load-bearing surface of the base portion and a sole of the foot of the user.

* * * * *